US006482575B2

(12) United States Patent
Tokai et al.

(10) Patent No.: US 6,482,575 B2
(45) Date of Patent: Nov. 19, 2002

(54) METHOD OF PREPARING BARRIER RIB MASTER PATTERN FOR BARRIER RIB TRANSFER AND METHOD OF FORMING BARRIER RIBS

(75) Inventors: Akira Tokai, Kawasaki (JP); Osamu Toyoda, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/826,902

(22) Filed: Apr. 6, 2001

(65) Prior Publication Data

US 2002/0042025 A1 Apr. 11, 2002

(30) Foreign Application Priority Data

Oct. 5, 2000 (JP) ..... 2000-306543

(51) Int. Cl.[7] ..... H01J 9/24

(52) U.S. Cl. ..... 430/321; 430/320; 430/394; 313/582; 313/584

(58) Field of Search ..... 430/320, 321, 430/394; 313/582, 584; 445/24

(56) References Cited

U.S. PATENT DOCUMENTS

2001/0026339 A1 * 10/2001 Choi et al. ..... 349/123

FOREIGN PATENT DOCUMENTS

| | | | |
|---|---|---|---|
| JP | 11-111165 A | * | 4/1999 |
| JP | 2000-011865 A | * | 1/2000 |
| JP | 2001-042504 A | * | 2/2001 |
| JP | 2001-057147 A | * | 2/2001 |

* cited by examiner

*Primary Examiner*—John A. McPherson
(74) *Attorney, Agent, or Firm*—Staas & Halsey LLP

(57) ABSTRACT

A method of preparing a barrier rib master pattern for barrier rib transfer, which includes the steps of forming a photosensitive material layer on a substrate performing oblique exposure by projecting exposure light onto the photosensitive material layer with the intervention of a photomask obliquely with respect to the substrate, and developing the photosensitive material layer, whereby a rib pattern having tapered side walls is formed on the substrate.

9 Claims, 17 Drawing Sheets

FIG.5
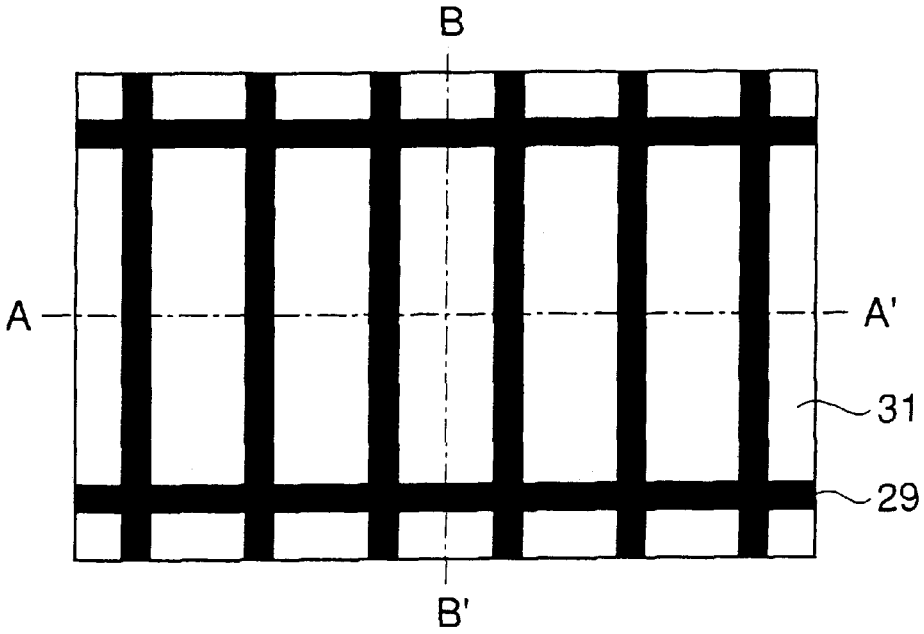
FIG.6(b)
FIG.6(a)
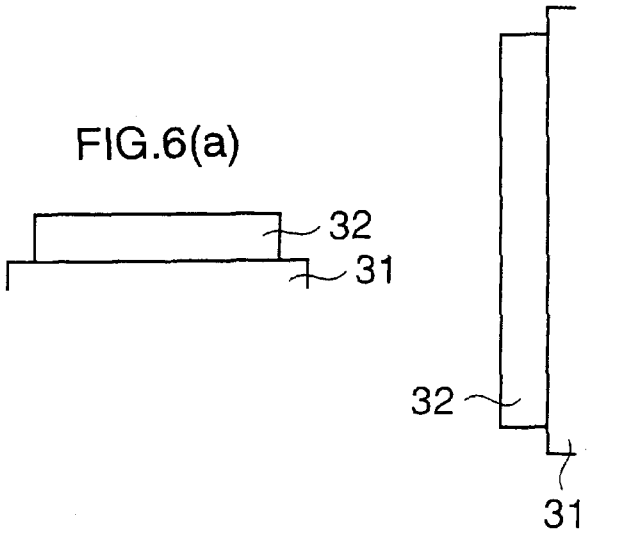

METHOD OF PREPARING BARRIER RIB MASTER PATTERN FOR BARRIER RIB TRANSFER AND METHOD OF FORMING BARRIER RIBS

CROSS-REFERENCE TO RELATED APPLICATION

This application is related to Japanese Patent Application No. 2000-306543 filed on Dec. 5, 2000, whose priority is claimed under 35 USC §119, the disclosure of which is incorporated by reference in its entirety.

BACKGROUND OF THE INVENTION

1. Field of the Invention

The present invention relates to a method of preparing a barrier rib master pattern for barrier rib transfer and a method of forming barrier ribs. More particularly, the invention relates to a barrier rib master pattern preparation method and a barrier rib formation method, which are employed for formation of barrier ribs of a display panel such as a plasma display panel (PDP).

2. Description of the Related Art

In recent years, production processes have been established for display panels such as PDPs, particularly, for surface discharge PDPs, allowing for production of large-screen PDPs. Even with the establishment of the production processes, the PDPs still have lower luminous efficiencies, requiring enhancement of the efficiency. PDPs of an ALiS (alternate lighting of surfaces) structure have been developed, which are capable of displaying a high vision image source on an interlace basis to achieve higher performance. However, such PDPs require improvement in driving margin, because display electrodes are arranged with uniform gaps defined therebetween for retention discharge.

Among these PDPs, display panels of an AC-driven tri-electrode surface discharge type are currently dominant. In the display panels, a plurality of address (signal) electrodes are arranged parallel to each other as extending vertically on one of opposed substrates (typically a rear substrate) with barrier ribs interposed therebetween, and pairs of display electrodes for surface discharge are arranged parallel to each other as extending laterally on the other substrate (typically a front substrate) with discharge gaps defined between the respective pairs of display electrodes.

The PDPs of the surface discharge type having the elongated barrier ribs and the linear display electrodes typically have a pixel size of about lmm on a 42-inch wide VGA screen. Where an HDTV-class resolution is required with this structure, the pixel size should be reduced to 500 $\mu$m, making the PDP production difficult. For this reason, the PDPs of the ALiS structure have been developed which realize the HDTV-class resolution on a 42-inch interlaced screen.

In the ALiS PDPs, the display electrodes are arranged at regular intervals (generally equidistantly) to define the discharge gaps therebetween. In this case, vertical coupling of discharge spaces in each row is suppressed by spatial barriers and potential barriers. However, a sufficient driving margin cannot be ensured with the spatial barriers, because the discharge gaps are defined between the respective display electrodes. One approach to this problem is to physically suppress the vertical coupling of the discharge spaces by providing barrier ribs of cross grid configuration.

While the aforesaid electrode arrangement has been developed, a variety of barrier rib formation methods have been developed. Exemplary methods hitherto known for the barrier rib formation include a sandblast method suitable for mass-production, a method employing a photosensitive barrier rib material, and a transfer method.

In the sandblast method, a particulate abrasive is blasted onto a dry barrier rib material film with the intervention of a mask pattern to physically cutting unnecessary portions of the film. In this method, the barrier rib configuration can be varied depending on the strength of the film, the particle diameter and shape of the abrasive, and the blasting period.

The method employing the photosensitive barrier rib material includes the steps of projecting a light beam having an exposure wavelength (typically ultraviolet light) onto a photosensitive barrier rib material film of a negative type (photo-curable type) with the intervention of a mask pattern, and removing unnecessary portions of the film by development thereof. In this method, the barrier rib configuration can be varied depending on the sensitivity of the photosensitive material.

The transfer method includes the steps of preparing a master pattern having the same configuration as barrier ribs to be formed, impressing the master pattern in a silicone rubber or the like to prepare an intaglio pattern as a matrix for the barrier ribs, filling the intaglio pattern with a barrier rib material for formation of a barrier rib pattern, transferring the barrier rib pattern onto a glass substrate for formation of the barrier ribs. In this method, the barrier rib configuration can be varied depending on the configuration of the master pattern.

In the AC-driven tri-electrode surface discharge PDPs and the ALiS PDPs described above, cells (discharge spaces) as minimum luminous units are laterally defined between barrier ribs, and a fluorescent layer is formed in each of the cells. Light from the fluorescent layer is reflected on the barrier ribs, so that the luminous efficiency varies depending on the configuration of the barrier ribs, particularly, the taper angle of side walls (side faces) of the barrier ribs. More specifically, the light cannot efficiently be directed toward a display surface depending on the taper angle of the barrier ribs, whereby the light may be repeatedly reflected on the interior of the cell to be partially leaked to the rear side. In the case of the cross grid barrier ribs, flickering dependent on a vertical view angle may occur due to a shadowing effect of lateral barrier ribs, if the lateral barrier ribs have an improper taper angle. Where the barrier ribs are formed by the transfer method, it is necessary to properly taper the barrier rib pattern for easy release thereof.

In the AC-driven tri-electrode surface discharge PDPs and the ALiS PDPs, the luminous efficiency is significantly influenced by the barrier rib configuration, particularly, by the taper angle of the barrier ribs. Further, where the barrier ribs are formed by the transfer method, the release of the barrier rib pattern is significantly influenced by the taper angle of the barrier ribs.

Among the aforesaid barrier rib formation methods, the sandblast method has a difficulty in finely controlling the taper angle of the barrier ribs by controlling the strength of the film, the shape and particle diameter of the abrasive, and the blasting period.

In the case of the method employing the photosensitive barrier rib material, the barrier ribs may have an inversely tapered configuration (having a smaller width at the bottom than at the top) due to attenuation of the light intensity, if they are formed through a single light exposure process. Although the barrier ribs can be formed as having a given cross section by performing the light exposure process several times or by controlling the photosensitivity of the photosensitive barrier rib material, it is difficult to variably control the taper angle of the barrier ribs. Particularly, where the photosensitive barrier rib material contains a filler which blocks light of a specific wavelength, the sensitivity of the photosensitive material is influenced by the filler, making it difficult to control the taper angle.

The transfer method allows for the formation of the straight barrier ribs, but has a lot of problems associated with the formation of the cross grid barrier ribs. Particularly, the preparation of the master pattern in the transfer method is achieved by forming a metal pattern through a mechanical cutting process. This method is applicable only to the preparation of a master pattern for the straight barrier ribs, but it is difficult to prepare a master pattern for barrier ribs of a honeycomb or cross grid configuration.

As described above, the conventional barrier rib formation methods have a difficulty in forming the barrier ribs with a finely controllable taper angle, particularly, in forming the cross grid barrier ribs. This makes it difficult to produce a PDP having a barrier rib configuration which is capable of efficiently directing the light toward a display surface and suppressing the flickering occurring due to a luminous variation.

In view of the foregoing, the present invention is directed to a method of preparing a barrier rib master pattern for barrier rib transfer, which ensures highly accurate and stable formation of a rib pattern having properly tapered side walls by projecting exposure light obliquely onto a photosensitive material with the intervention of a photomask, and to a barrier rib formation method for forming barrier ribs having properly tapered side walls directly on a PDP substrate for production of a PDP which is capable of efficiently directing light toward a display surface and suppressing the flickering.

SUMMARY OF THE INVENTION

In accordance with the present invention, there is provided a method of preparing a barrier rib master pattern for barrier rib transfer, comprising the steps of: forming a photosensitive material layer on a substrate; performing oblique exposure by projecting exposure light onto the photosensitive material layer with the intervention of a photomask obliquely with respect to the substrate; and developing the photosensitive material layer; whereby a rib pattern having tapered side walls is formed on the substrate.

In the present invention, the exposure light is projected obliquely onto the photosensitive material layer with the intervention of the photomask for the formation of the rib pattern having the tapered side walls on the substrate. Therefore, the barrier rib master pattern can easily be prepared as having a rib pattern tapered at a desired taper angle to ensure easy release of a barrier rib pattern at the transfer thereof.

Further, the barrier rib master pattern can easily be prepared as having a cross grid rib pattern.

Therefore, barrier rib transfer and release processes can stably be performed with a high yield in the barrier rib formation by the transfer method by employing an intaglio pattern prepared with the use of the barrier rib master pattern.

In a PDP which has barrier ribs formed as having tapered side walls by employing the barrier rib master pattern, light can efficiently be directed toward a display surface. Further, the flickering which may otherwise occur due to shadowing by lateral barrier ribs of the cross grid barrier ribs can be suppressed by the tapered side walls of the barrier ribs.

BRIEF DESCRIPTION OF THE DRAWINGS

FIG. 5 is a plan view illustrating a part of a barrier rib master pattern having a cross grid rib pattern for barrier rib transfer in accordance with the present invention;

FIGS. 6(*a*) and 6(*b*), FIGS. 7(*a*) and 7(*b*), and FIGS. 8(*a*) and 8(*b*) are diagrams for explaining a method of preparing the barrier rib master pattern in accordance with Example 2 of the present invention;

DETAILED DESCRIPTION OF THE INVENTION

Figure 1:
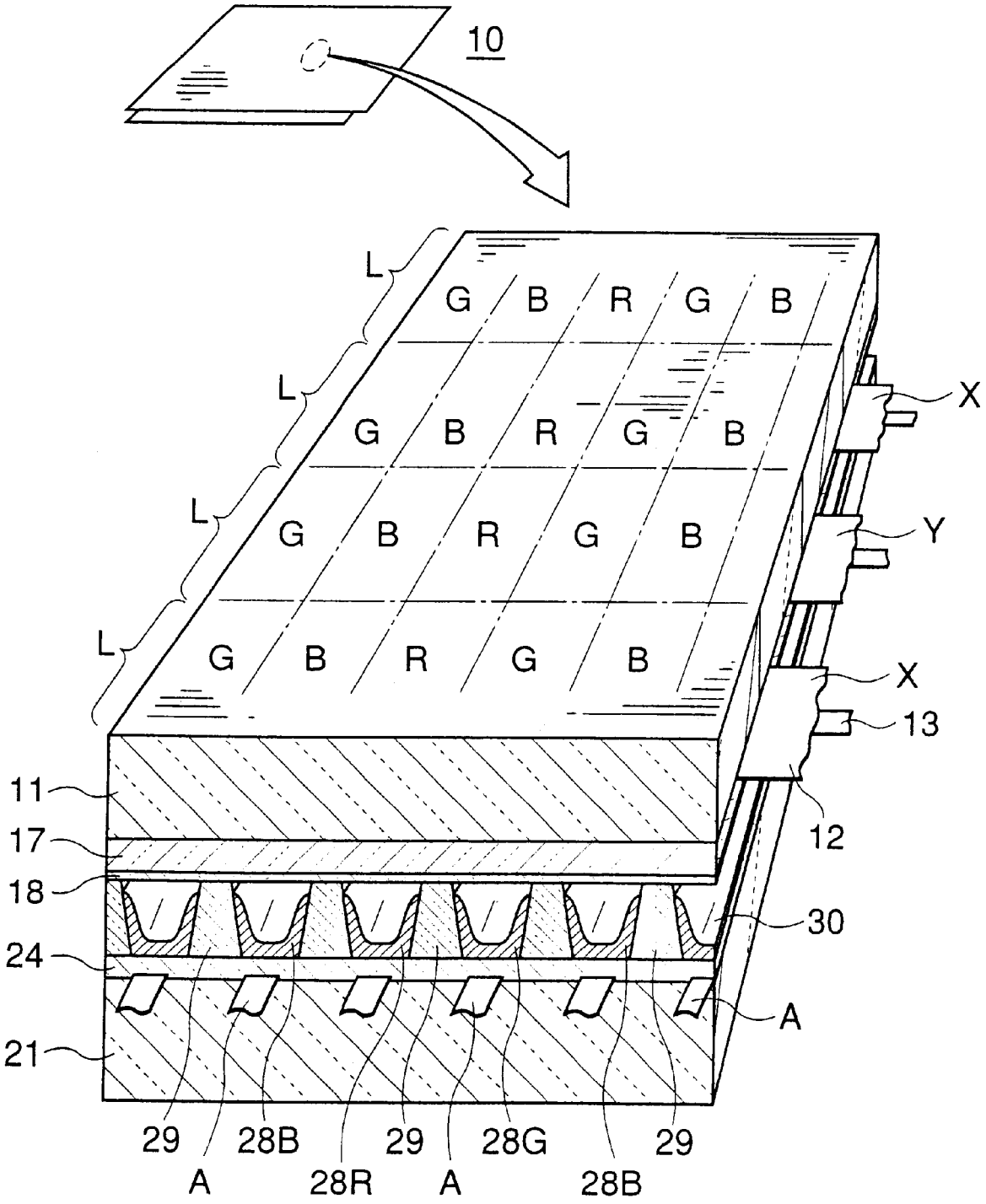
FIG. 1 is a perspective view illustrating a part of an AC-driven tri-electrode surface discharge PDP of an ALiS structure.
Figure 2A:
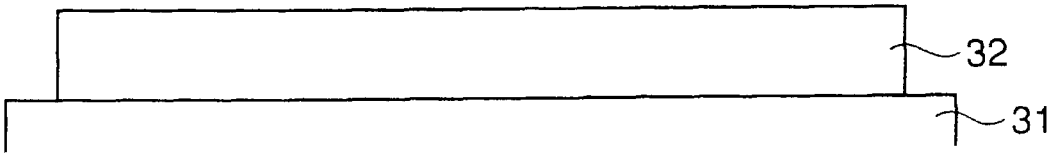
FIGS. 2(*a*) to 2(*d*) are diagrams for explaining a method of preparing a barrier rib master pattern for barrier rib transfer according to Example 1 of the present invention.
Figure 2B:
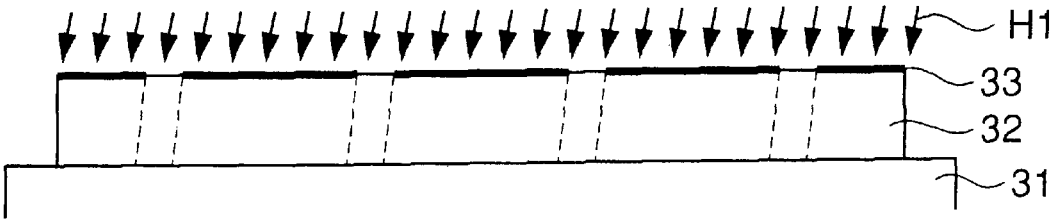
Figure 2C:
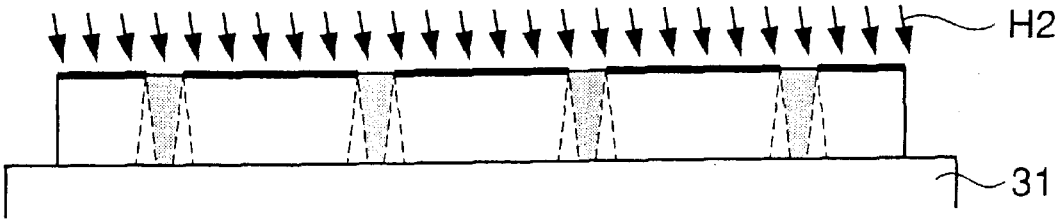
Figure 2D:
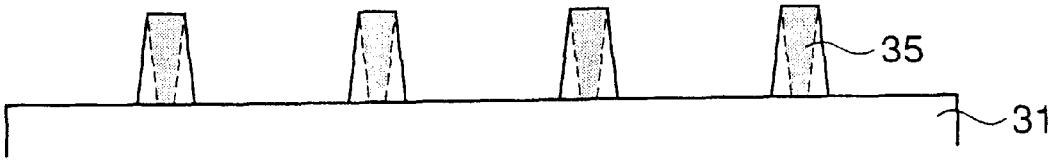
Figure 3A:
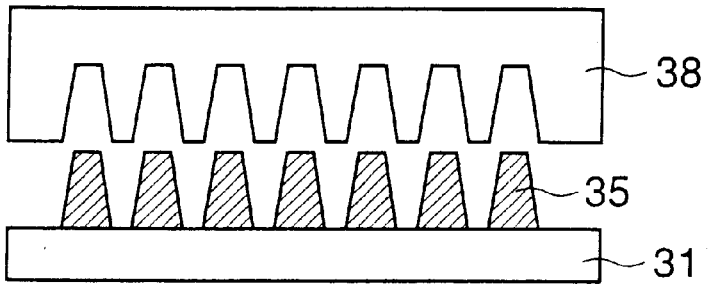
FIGS. 3(*a*) to 3(*d*) are diagrams for explaining a method of preparing an intaglio pattern with the use of the barrier rib master pattern and a method of forming barrier ribs by the transfer method.
Figure 3B:
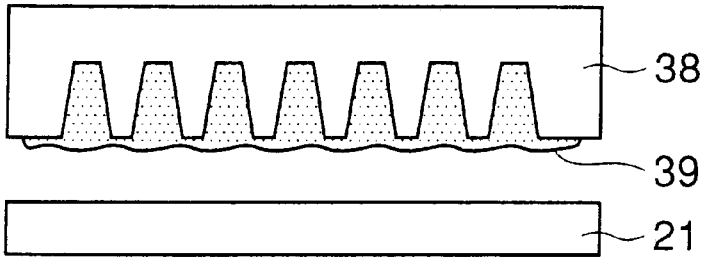
Figure 3C:
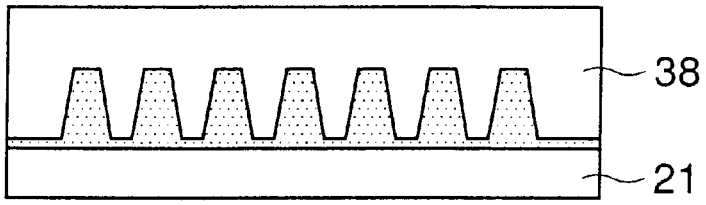
Figure 3D:
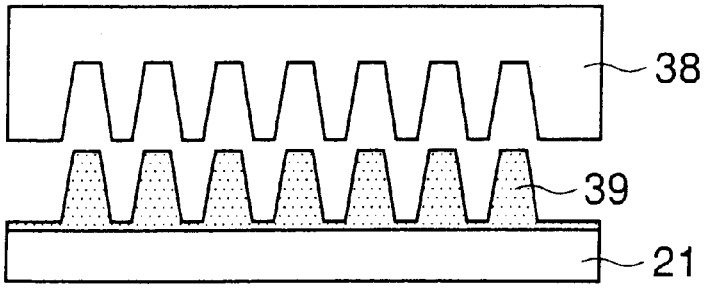

According to the present invention, a method of preparing a barrier rib master pattern for barrier rib transfer comprises the steps of: forming a photosensitive material layer on a substrate; performing oblique exposure by projecting exposure light onto the photosensitive material layer with the intervention of a photomask obliquely with respect to the substrate; and developing the photosensitive material layer; whereby a rib pattern having tapered side walls is formed on the substrate.

Examples of the substrate to be employed in the present invention include glass, quartz, ceramic and resin substrates, and substrate structures having desired components such as electrodes, an insulating film, a dielectric film and a protective film formed on any of the aforesaid substrates.

The photosensitive material layer can be formed by applying a liquid resist to a desired thickness on the substrate and drying the resist. Alternatively, the formation of the photosensitive material layer may be achieved by stacking a plurality of photosensitive resin sheets each having a predetermined thickness to a desired thickness on the substrate by a laminator. Photoresists to be employed for a known photolithography technique are usable as the resist. Usable as the photosensitive resin sheet is a dry resist film composed of an acrylic resin, a photopolymerizable acrylic monomer, an additive and the like. Specific examples of the dry resist film include ALPHO NIT600 series dry resist films available from Nippon Synthetic Chemical Industry Co., Ltd. In order to impart the rib pattern with a uniform height, it is desirable to use the dry resist film. The use of the dry resist film having a uniform thickness allows for easier preparation of the barrier rib master pattern with a high level of height accuracy.

The oblique exposure with the intervention of the photomask can be achieved with the use of a known light exposure system to be employed for projecting a collimated light beam in an ordinary photolithography technique. The collimated light exposure system employs an ultra-high pressure mercury lamp as a light source, and is adapted to collimate light emitted from the light source by a parabolic mirror or a Fresnel lens for the light exposure.

For the oblique exposure, the substrate to be exposed is held as tilted on a stage of the light exposure system. Alternatively, the light source may be tilted with respect to the substrate, or light refracting means such as a lens and a mirror may be employed for the oblique exposure.

The oblique exposure is advantageous in that a uniform irradiation area required for the oblique light exposure is smaller than that required for straight-forward light exposure and, hence, the dimensional increase of a lamp associated peripheral member (parabolic mirror or the like) of the light exposure system can be avoided.

In this case, the light exposure may be achieved by an overall light exposure method in which the entire substrate is exposed to the light at a time or by a divisional light exposure method in which a plurality of sections of the substrate are exposed to the light on a section-by-section basis. The latter method, in which the substrate and the lamp associated peripheral member of the light exposure system are moved relative to each other, is more advantageous in that the size of the lamp associated peripheral member can be reduced.

In the inventive method, in order that the rib pattern includes rib portions each having a trapezoidal cross section with opposite side walls upwardly tapered, it is desirable to perform the oblique exposure twice by projecting the exposure light in directions corresponding to inclinations of the opposite side walls of the rib portions.

Where the rib pattern to be formed on the substrate has a cross grid configuration as viewed in plan and includes vertical rib portions and lateral rib portions each having opposite side walls upwardly tapered, it is desirable to perform the oblique exposure four times by projecting the exposure light in directions corresponding to inclinations of the opposite side walls of the vertical rib portions and in directions corresponding to inclinations of the opposite side walls of the lateral rib portions.

Where the rib pattern to be formed on the substrate has a cross grid configuration as viewed in plan and includes first rib portions each extending in a first direction and having opposite side walls upwardly tapered and second rib portions each extending in a second direction perpendicular to the first direction and having opposite side walls upwardly tapered less steeply than the side walls of the first rib portions, it is desirable to perform the oblique exposure four times by projecting the exposure light at different angles with respect to the substrate in directions corresponding to inclinations of the opposite side walls of the first rib portions and in directions corresponding to inclinations of the opposite side walls of the second rib portions. With this arrangement, a barrier rib pattern formed of a barrier rib material in an intaglio pattern prepared with the use of the barrier rib master pattern can be transferred onto a PDP substrate and released from the intaglio pattern by peeling off the intaglio pattern in the first direction.

After the oblique exposure, the exposure light may further be projected onto a longitudinal end formation region of the photosensitive material layer obliquely with respect to the substrate, so that the rib pattern has gently tapered longitudinal ends.

After the barrier rib master pattern is prepared in the aforesaid manner, an intaglio pattern for barrier rib transfer is prepared with the use of the barrier rib master pattern, and a barrier rib pattern is formed of a barrier rib material in the intaglio pattern and transferred onto a PDP glass substrate formed with electrodes and a dielectric layer for formation of barrier ribs.

More specifically, the preparation of the intaglio pattern is achieved by impressing the barrier rib master pattern in a silicone rubber. For example, the barrier rib master pattern is set in an injection system and, after a liquid or paste silicone rubber matrix material and a curing agent are mixed together, the mixture is injected into the injection system. Then, the mixture is allowed to stand or heated so as to be hardened for the preparation of the intaglio pattern.

The transfer of the barrier rib pattern from the intaglio pattern is achieved by filling a barrier rib material paste in recesses of the intaglio pattern for the formation of the barrier rib pattern and pressing the barrier rib pattern against the PDP glass substrate. Thereafter, the barrier rib pattern is subjected to known processes such as drying and baking processes for the formation of the barrier ribs on the PDP glass substrate.

The present invention further provides a barrier rib formation method, which comprises the steps of: forming a photosensitive barrier rib material layer on a substrate; projecting exposure light onto the barrier rib material layer with the intervention of a photomask obliquely with respect to the substrate; and developing the barrier rib material layer; whereby barrier ribs each having tapered side walls are formed on the substrate.

In the inventive barrier rib formation method, a barrier rib pattern can be formed directly on the PDP glass substrate in substantially the same manner as in the barrier rib master pattern preparation method by employing the PDP glass substrate formed with the electrodes and the dielectric layer instead of the substrate used in the master pattern preparation method and by forming the photosensitive barrier rib material layer instead of the photosensitive material layer by applying a photosensitive barrier rib material such as a glass paste composed of a low melting point glass frit, a binder, a solvent and the like onto the PDP glass substrate and drying the photosensitive barrier rib material layer. The barrier rib pattern thus formed is dried and baked by a known method for the formation of the barrier ribs.

With reference to the attached drawings, the present invention will hereinafter be described by way of embodiments thereof. However, it should be understood that the invention be not limited to these embodiments.

An explanation will be given to the construction of a PDP to which the barrier rib master pattern preparation method and the barrier rib formation method according to the present invention are applied. The inventive methods are applicable. to PDPs of any construction having barrier ribs. Since the inventive methods are advantageously applied to an AC-driven tri-electrode surface discharge PDP, particularly, of an ALiS structure, the following embodiments are directed to the formation of the barrier ribs for this type of PDP.

FIG. 1 is a perspective view illustrating a part of the AC-driven tri-electrode surface discharge PDP of the ALiS structure. As shown, the PDP 10 includes a front panel assembly having a front substrate 11, and a rear panel assembly having a rear substrate 21. The front substrate 11 and the rear substrate 12 are each formed of glass.

Display electrodes X, Y provided on an inner surface of the front substrate 11 are formed of a known material by a known method. More specifically, the display electrodes X, Y each include a transparent electrode 12 such as of ITO or $SnO_2$, and a bus electrode 13 of a metal such as Ag, Au, Al, Cu or Cr, or a laminate of any of these metals (e.g., a Cr/Cu/Cr laminate structure) for reduction of the resistance of the display electrodes. Where the display electrodes X, Y are formed of Ag or Au, the formation thereof is achieved by a printing method. Where the display electrodes X, Y are formed of any other material, the formation thereof is achieved by a combination of a film formation method such as vapor deposition or sputtering and an etching method. Thus, a desired number of display electrodes having a desired thickness and a desired width can be formed at desired intervals. Either the display electrodes X or the display electrodes Y serve as scanning electrodes.

A dielectric layer 17 covering the display electrodes X, Y is formed of a material typically employed for the PDPs. More specifically, a glass paste composed of a low melting point glass frit, a binder, a solvent and the like, for example, is applied onto the substrate by a screen printing method and baked for the formation of the dielectric layer 17.

A protective film 18 is usually provided on the dielectric layer 17 for protecting the dielectric layer 17 from a damage due to impingement of ions generated by discharge during display. The protective film 18 is formed of a known material such as MgO, CaO, SrO or BaO.

Address electrodes A provided on an inner surface of the rear substrate 21 are formed of a known material by a known method. More specifically, the address electrodes A are formed of Ag, Au, Al, Cu or Cr, or a laminate of any of these metals (e.g., a Cr/Cu/Cr laminate structure). Where the address electrodes A are formed of Ag or Au, the formation thereof is achieved by a printing method like the formation of the display electrodes X, Y. Where the address electrodes A are formed of any other material, the formation thereof is achieved by a combination of a film formation method such as vapor deposition or sputtering and an etching method. Thus, a desired number of address electrodes having a desired thickness and a desired width can be formed at desired intervals.

A dielectric layer 24 covering the address electrodes A are formed of the same material by the same method as the dielectric layer 17.

Barrier ribs 29 on the dielectric layer 24 are formed by a transfer method employing a barrier rib master pattern prepared in accordance with the present invention (which will be described later) or by a barrier rib formation method according to the present invention (which will be described later).

Fluorescent layers 28R, 28G, 28B provided between the barrier ribs 29 are each formed of a known material by a known method. More specifically, a fluorescent paste composed of a fluorescent powder and a binder, for example, is applied into grooves between the barrier ribs 29 by screen printing or with the use of a dispenser. This process is repeatedly performed on a color-by-color basis, and then the fluorescent pastes thus applied are dried and baked for the formation of the fluorescent layers. The formation of the fluorescent layers 28R, 28G, 28B may be achieved by a photolithography method employing photosensitive fluorescent material sheets (so-called green sheets) each composed of a fluorescent powder and a binder. In this case, a sheet of a desired color is applied over a display area of the substrate, followed by light exposure and development. This process is repeatedly performed on a color-by-color basis for the formation of the respective color fluorescent layers in the corresponding grooves between the barrier ribs.

The PDP 10 is produced by combining the front panel assembly and the rear panel assembly in an opposed relation with the display electrodes X, Y being orthogonal to the address electrodes A, sealing the periphery of the combined panel assemblies, and filling a discharge gas such as neon or xenon into discharge spaces 30 defined between the barrier ribs 29. In the PDP 10, the discharge spaces are defined at intersections of the address electrodes A and zones defined between the respective display electrodes X and Y, and each serve as a cell (unit luminous area) which is a minimum display unit.

The aforesaid construction is merely illustrative of the present invention, but not limitative of the same. The invention is applicable to PDPs of any construction having barrier ribs.

Next, an explanation will be given to the formation of the barrier ribs 29 of the PDP 10. In the following examples, a barrier rib master pattern is first prepared, and then an intaglio pattern (negative pattern) is prepared by employing a silicone rubber with the use of the master pattern. A barrier rib pattern is formed of a barrier rib material in the intaglio pattern, and transferred onto the PDP substrate. Alternatively, the intaglio pattern may be used as a press plate, so that the barrier rib pattern is pressed on the PDP substrate for the formation of the barrier ribs.

EXAMPLE 1

FIGS. 2(*a*) to 2(*d*) are diagrams for explaining a method of preparing a barrier rib master pattern for barrier rib transfer according to Example 1 of the present invention.

In the barrier rib master pattern preparation method, a plurality of dry resist films composed of an acrylic resin, a photopolymerizable acrylic monomer, an additive and the like are stacked on a substrate 31 such as of glass, quartz, ceramic or resin to a thickness (about 100 μm to about 3000 μm) corresponding to a desired barrier rib height by a laminator for formation of a photosensitive material layer 32 (see FIG. 2(*a*)).

Subsequently, a photomask 33 is placed on the photosensitive material layer 32 for shielding portions of the photosensitive material layer 32 other than a rib pattern formation region from light, and then the resulting substrate is subjected to light exposure. For the light exposure, a light exposure system is employed, which is adapted to emit collimated light. The substrate 31 is held as tilted on a stage of the light exposure system. More specifically, the first light exposure is performed by projecting exposure light H1 obliquely with respect to the substrate 31 for so-called oblique exposure (see FIG. 2(*b*)).

In turn, the substrate 31 is tilted in an opposite direction, and then subjected again to the oblique exposure. More specifically, the second light exposure is performed by projecting exposure light H2 obliquely with respect to the substrate 31 in a direction opposite to the previous light exposure direction with respect to a plane perpendicular to the substrate 31 (see FIG. 2(*c*)).

The collimated light exposure system employs an ultra-high pressure mercury lamp as a light source, and is adapted to collimate the light from the light source by a parabolic mirror or a Fresnel lens for the light exposure.

For the oblique exposure, the substrate 31 is not necessarily required to be held as tilted, but the light source may be tilted, or light refracting means such as a lens and a mirror may be employed. The oblique exposure is advantageous in that a uniform irradiation area required for the oblique exposure is smaller than that required for straightforward light exposure and, hence, the dimensional increase of a lamp associated peripheral member (parabolic mirror or the like) of the light exposure system can be avoided.

The light exposure may be achieved by either an overall light exposure method or a divisional light exposure method. In the case of the divisional light exposure, the substrate and the lamp associated peripheral member of the light exposure system are moved relative to each other, so that the size of the lamp associated peripheral member can be reduced.

Subsequently, the photosensitive material layer 32 is developed by spraying a sodium carbonate aqueous solution onto the photosensitive material layer for formation of a rib pattern 35 (see FIG. 2(*d*)).

The photomask 33 and the light exposure system for projection of the exposure light H1, H2 may be those employed in an ordinary photolithography technique. The developing process may be performed in the same manner as in the ordinary photolithography technique.

According to Example 1, a rib pattern was actually formed in the following manner. A 200-μm thick photosensitive material layer 32 was formed on a substrate by staking four 50-μm thick dry resist films of ALPHO NIT600 series available from Nippon Synthetic Chemical Industry Co., Ltd. Then, the photosensitive material layer was subjected to the light exposure at a tilt angle of about 25 degrees to about 45 degrees and to the development. Thus, a rib pattern was obtained, which had side walls tapered at about 15 degrees to about 25 degrees.

After the development, the resulting substrate is dried, and the exposure light is projected over the entire substrate to further polymerize the photosensitive resin material for suppression of deformation and reaction of the resin material which may otherwise occur due to pressure and heat applied when an intaglio pattern is formed. Then, the substrate is heated up to a temperature employed for the preparation of the intaglio pattern for further drying. Thus, the barrier rib master pattern is completed.

As described above, the barrier rib master pattern having the rib pattern upwardly tapered in cross section can be formed by employing the photosensitive resin material and performing the oblique exposure twice.

FIGS. 3(*a*) to 3(*d*) are diagrams for explaining a method of preparing an intaglio pattern with the use of the barrier rib master pattern and a method of forming barrier ribs by the transfer method.

After the preparation of the barrier rib master pattern, an intaglio pattern 38 is prepared by impressing the barrier rib master pattern 35 in a silicone rubber (see FIG. 3(*a*)). More specifically, the barrier rib master pattern is set in an injection system and, after a liquid or paste silicone rubber matrix material and a curing agent are mixed together, the mixture is injected into the injection system. Then, the mixture is allowed to stand or heated so as to be hardened for the preparation of the intaglio pattern 38.

A barrier rib material paste is filled in recesses of the intaglio pattern 38 for formation of a barrier rib pattern 39 (see FIG. 3(*b*)), and the barrier rib pattern 39 is pressed against a PDP rear glass substrate 21 formed with electrodes or with electrodes and a dielectric layer (see FIG. 3(*c*)). Then, the barrier rib pattern 39 is released from the intaglio pattern 38 thereby to be transferred onto the substrate 21 (see FIG. 3(*d*)).

Thereafter, the resulting substrate is subjected to known processes such as drying and baking processes for formation of barrier ribs on the PDP rear glass substrate 21.

Figure 4A:
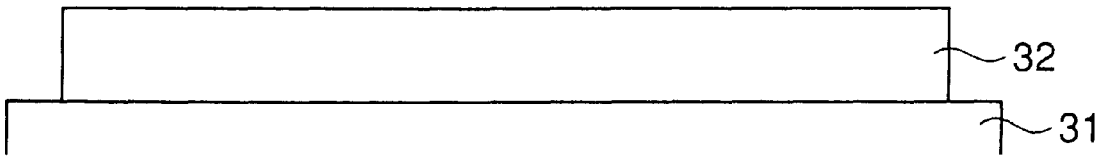
FIGS. 4(*a*) to 4(*c*) are diagrams for explaining a comparative example in which oblique exposure is not performed.
Figure 4B:
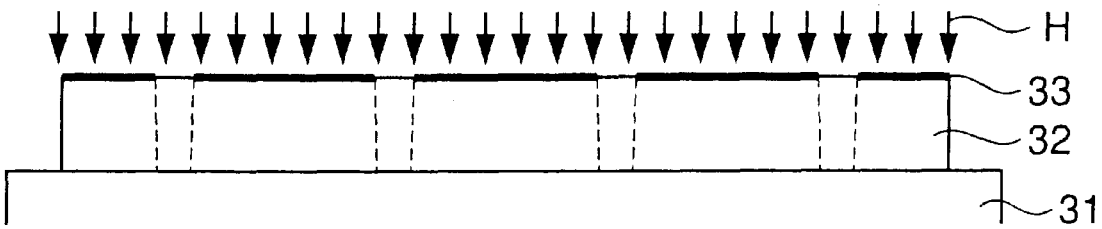
Figure 4C:
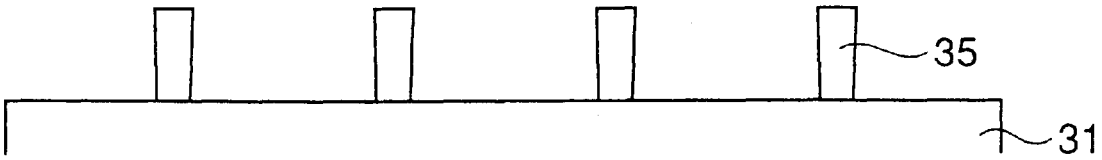

FIGS. 4(*a*) to 4(*c*) are diagrams for explaining a comparative example where oblique light exposure is not performed.

As shown, a photosensitive material layer 32 is formed on a substrate 31 (see FIG. 4(*a*)), then exposure light H is projected onto the photosensitive material layer with the intervention of a photomask 33 perpendicularly to the substrate 31 (see FIG. 4(*b*)), and the photosensitive material layer 32 is developed (see FIG. 4(*c*)) for formation of a rib pattern. The rib pattern thus formed has a smaller width at its bottom than at its top due to attenuation of the exposure light.

EXAMPLE 2

FIG. 5 is a plan view illustrating a part of a barrier rib master pattern having a rib pattern of a cross grid configuration for barrier rib transfer in accordance with the present invention. FIGS. 6(*a*) and 6(*b*), FIGS. 7(*a*) and 7(*b*), and FIGS. 8(*a*) and 8(*b*) are diagrams for explaining a barrier rib master pattern preparation method according to Example 2 of the present invention. Particularly, FIGS. 6(*a*), 7(*a*) and 8(*a*) are sectional views taken along a line A–A' in FIG. 5, and FIGS. 6(*b*), 7(*b*) and 8(*b*) are sectional views taken along a line B–B' in FIG. 5.

In Example 2, a barrier rib master pattern having a rib pattern of a cross grid configuration as seen in plane in FIG. 5 is prepared. A substrate 31, a photosensitive material layer 32 and a photolithography technique to be employed in Example 2 are the same as those employed in Example 1.

First, the photosensitive material layer 32 is formed on the substrate 31 (see FIGS. 6(*a*) and 6(*b*)).

Figure 7A:
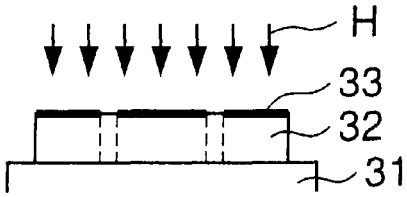
Figure 7B:
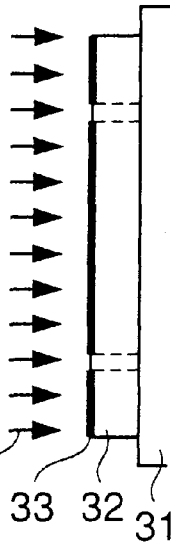

Then, a photomask 33 is placed on the photosensitive material layer 32 for shielding portions of the photosensitive material layer 32 other than a rib pattern formation region from light, and then exposure light H is projected perpendicularly to the substrate 31 (see FIGS. 7(*a*) and 7(*b*)).

Figure 8A:
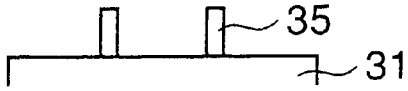
Figure 8B:
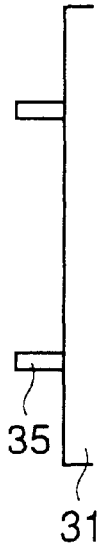

Subsequently, the photosensitive material layer is developed for formation of a rib pattern 35 (see FIGS. 8(*a*) and 8(*b*)).

EXAMPLE 3

Figure 9A:
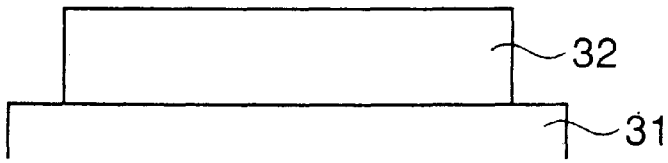
FIGS. 9(*a*) and 9(*b*), FIGS. 10(*a*) and 10(*b*), FIGS. 11(*a*) and 11(*b*), and FIGS. 12(*a*) and 12(*b*) are diagrams for explaining a method of preparing the barrier rib master pattern in accordance with Example 3 of the present invention.
Figure 9B:
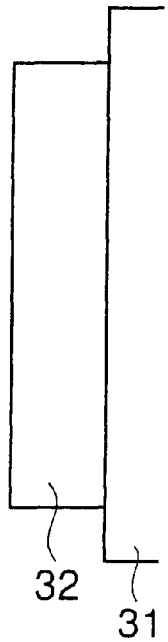
Figure 10A:
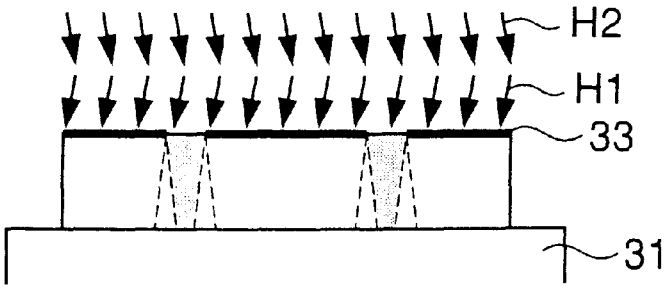
Figure 10B:
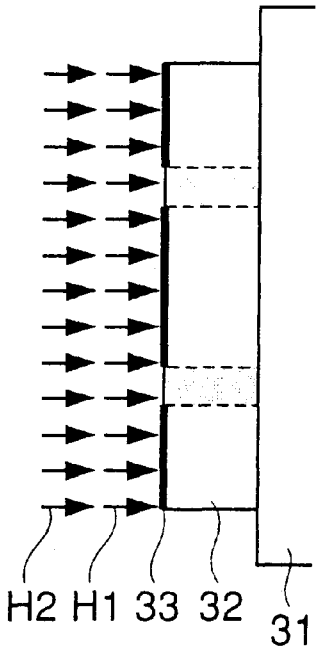
Figure 11A:
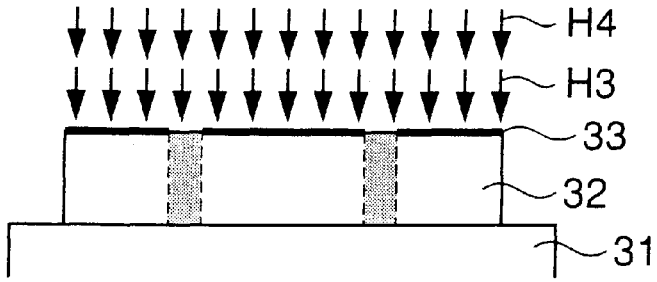
Figure 11B:
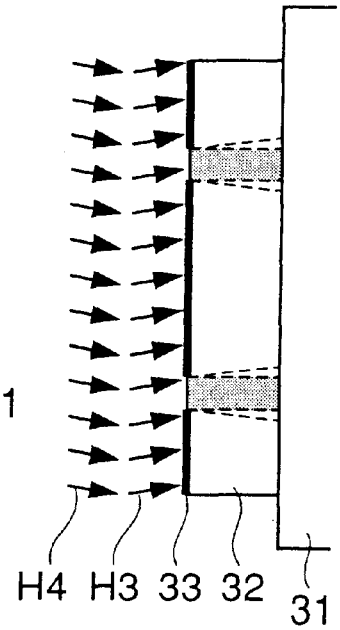
Figure 12A:
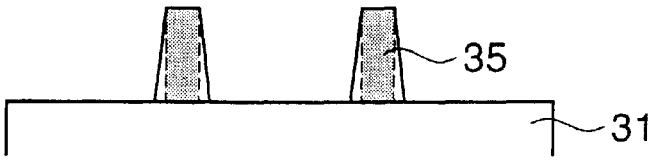
Figure 12B:
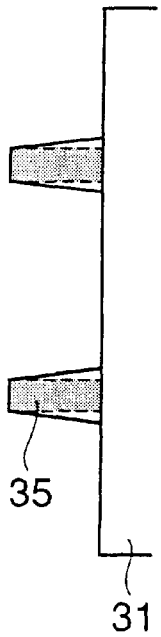
Figure 13:
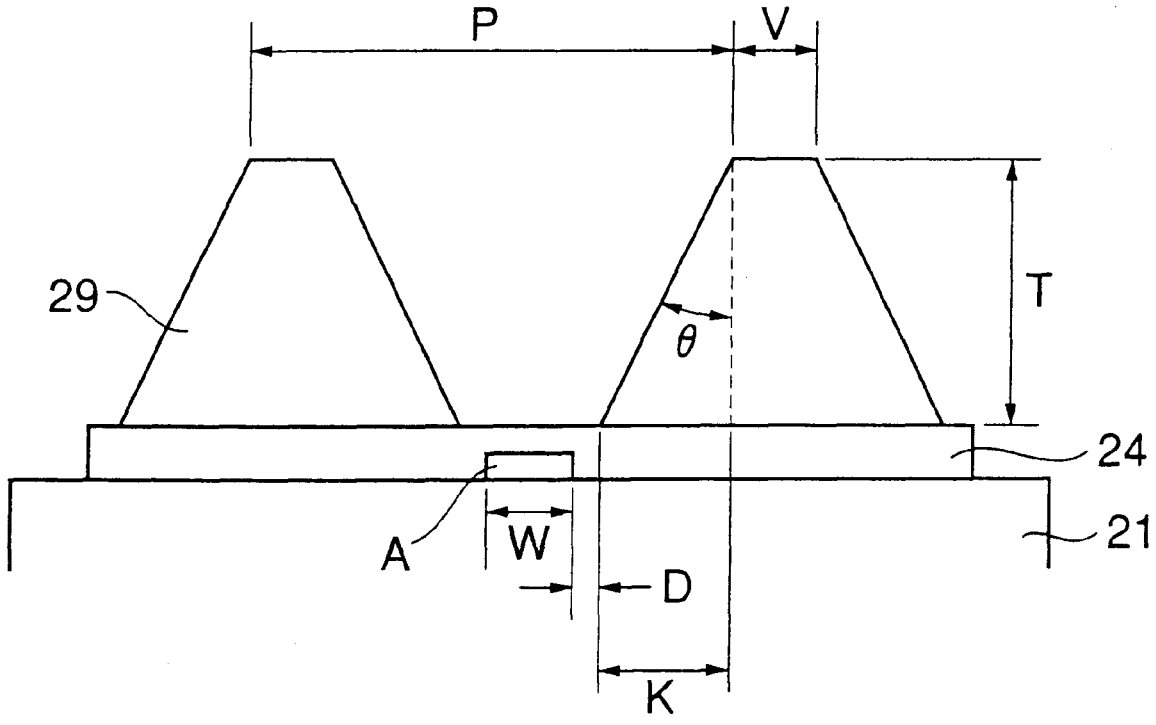
FIG. 13 is a diagram for explaining a proper taper angle of barrier ribs.

FIGS. 9(*a*) and 9(*b*), FIGS. 10(*a*) and 10(*b*), FIGS. 11(*a*) and 11(*b*), and FIGS. 12(*a*) and 12(*b*) are diagrams for explaining a barrier rib master pattern preparation method according to Example 3 of the present invention. Particularly, FIGS. 9(*a*), 10(*a*), 11(*a*) and 12(*a*) are sectional views taken along the line A–A' in FIG. 5, and FIGS. 9(*b*), 10(*b*), 11(*b*) and 12(*b*) are sectional views taken along the line B–B' in FIG. 5.

In Example 3, a barrier rib master pattern is prepared which has a rib pattern having a cross grid plan configuration and an upwardly tapered cross section as shown in FIG. 5. A substrate 31, a photosensitive material layer 32 and a photolithography technique to be employed in Example 3 are the same as those employed in Example 1.

First, the photosensitive material layer 32 is formed on the substrate 31 (see FIGS. 9(*a*) and 9(*b*)).

Subsequently, a photomask 33 is placed on the photosensitive material layer 32 for shielding portions of the photosensitive material layer 32 other than a rib pattern formation region from light. In turn, the first light exposure is performed by projecting exposure light H1 obliquely with respect to the line A–A' in FIG. 5. Then, the substrate 31 is tilted in an opposite direction, and the second light exposure is performed by projecting exposure light H2 in a direction opposite to the first light exposure direction (see FIGS. 10(*a*) and 10(*b*)).

Subsequently, the third light exposure is performed by projecting exposure light H3 obliquely with respect to the line B–B' in FIG. 5. Then, the substrate 31 is tilted in an opposite direction, and the fourth light exposure is performed by projecting exposure light H4 in a direction opposite to the third light exposure direction (see FIGS. 11(*a*) and 11(*b*)).

Thereafter, the photosensitive material layer is developed for formation of a rib pattern 35 (see FIGS. 12(*a*) and 12(*b*)).

The taper angle of side walls of the rib pattern formed through the oblique exposure is desirably defined as follows.

The maximum taper angle of the barrier ribs arranged parallel to the address electrodes in the PDP is calculated in consideration of limitations on the discharge spaces. Where a barrier rib pattern for a 42-inch wide PDP is to be formed with the use of the barrier rib master pattern, for example, the barrier rib pattern has a barrier rib pitch P of 360 $\mu$m, a barrier rib top width of 70 $\mu$m and a barrier rib height of 200 $\mu$m, and the address electrodes each have a width of 80 $\mu$m. Since it is necessary to provide a positioning margin of about 5 $\mu$m between the barrier ribs 29 and the address electrodes A, the bottom spread width of the barrier ribs is 100 $\mu$m. Accordingly, the maximum taper angle of the barrier ribs is $\tan^{-1}(K/T)=\tan^{-1}(100/200)=26.6$(degrees). Therefore, the taper angle $\theta$ of the barrier ribs is in the range of 0 degree$<\theta<$26.6 degrees in the case of the 42-inch wide PDP.

Where the barrier rib master pattern with the rib pattern having a cross grid plan configuration and an upwardly tapered cross section is prepared, the rib pattern is designed so that rib portions thereof extending in a first direction are tapered at a smaller taper angle than rib portions thereof extending in a second direction perpendicular to the first direction, whereby a barrier rib pattern formed of a barrier rib material in an intaglio pattern prepared with the use of the barrier rib master pattern can easily be transferred onto a PDP substrate and released from the intaglio pattern by peeling off the intaglio pattern in the first direction.

EXAMPLE 4

FIGS. 14 to 18 are diagrams for explaining a barrier rib master pattern preparation method according to Example 4 of the present invention. FIGS. 15 to 18 are sectional views taken along a line C–C' in FIG. 14.

In Example 4, a barrier rib master pattern is prepared, which has a rib pattern with rib portions each having longitudinally opposite ends upwardly tapered at a greater angle.

Figure 14:
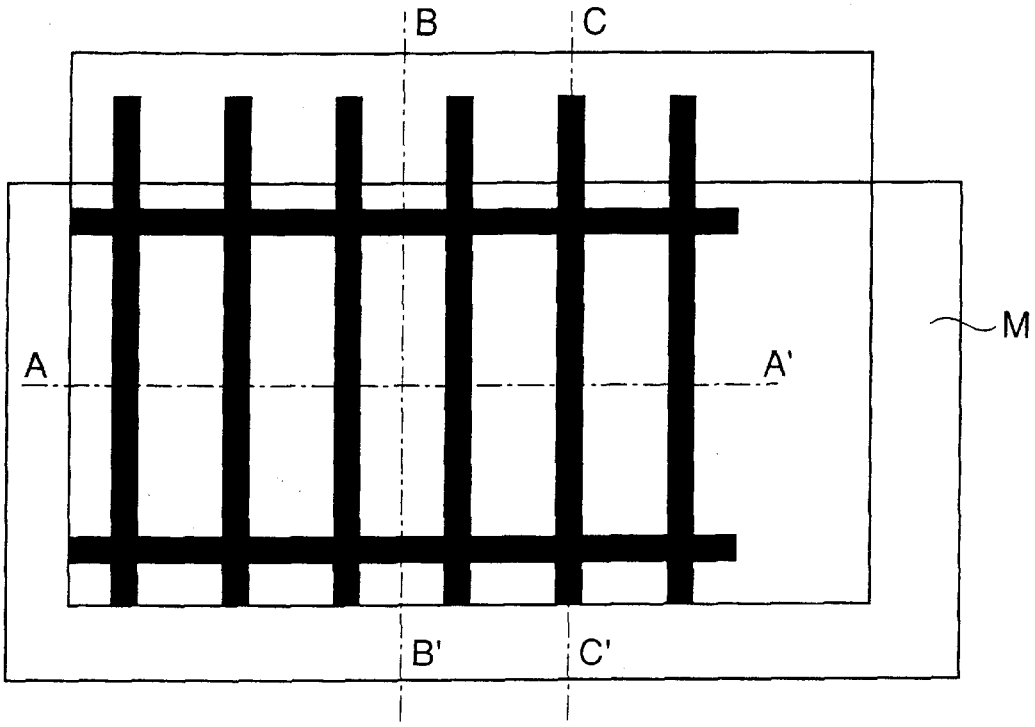
FIG. 14 to 18 are diagrams for explaining a method of preparing a barrier rib master pattern in accordance with Example 4 of the present invention.
Figure 15:
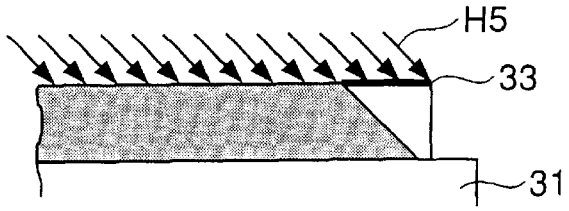
Figure 16:
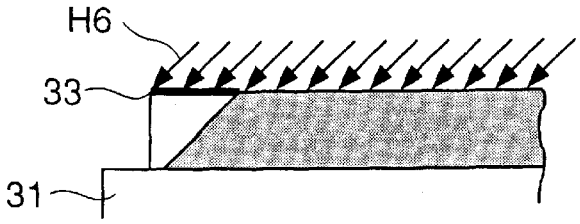

The formation of the photosensitive material layer and the oblique exposure are carried out in the same manner as in Example 3. Then, a grid pattern formation region of the photosensitive material layer is covered with a mask M as shown in FIG. 14, and the fifth light exposure is performed by projecting exposure light H5 obliquely onto one of longitudinally opposite end formation regions of the photosensitive material layer for vertical rib portions of the rib pattern (see FIG. 15). Then, the substrate 31 is tilted in an opposite direction, and the sixth light exposure is performed by projecting exposure light H6 obliquely on the other longitudinally opposite end formation region of the photosensitive material layer (see FIG. 16). Thereafter, longitudinally opposite end formation regions of the photosensitive material layer for lateral rib portions of the rib pattern may be subjected to the oblique exposure if necessary.

Figure 17:
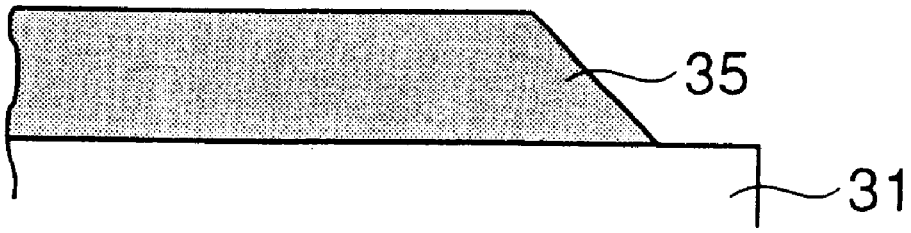
Figure 18:
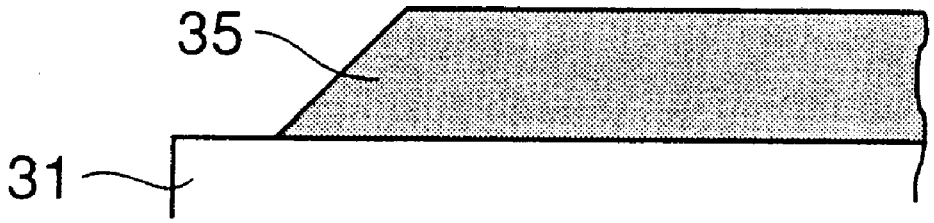

Then, the photosensitive material layer is developed, whereby the rib pattern 35 is formed which has the rib portions each having the longitudinally opposite ends upwardly tapered at a greater angle (see FIGS. 17 and 18).

As described above, the rib portions of the barrier rib master pattern extending in the intaglio pattern peeling direction (in the first direction) are preferably tapered at a taper angle of 0 degrees to 26.6 degrees, and the rib portions of the barrier rib master pattern extending perpendicularly to the intaglio pattern peeling direction (in the second direction) are preferably tapered at a taper angle greater than the taper angle of the barrier rib portions extending in the peeling direction. For easier peel-off of the intaglio pattern at the transfer of the rib pattern, the longitudinally opposite ends of the rib portions of the rib pattern are preferably tapered at a further greater angle than the taper angle of the barrier rib portions extending perpendicularly to the peeling direction.

By thus subjecting only the longitudinally opposite end formation regions of the photosensitive material layer to the oblique exposure at a greater tilt angle, the rib pattern is formed which has a cross grid configuration as viewed in plan and includes the rib portions having the longitudinal ends upwardly tapered at a greater taper angle. The method for tapering the longitudinally opposite ends of the rib portions of the rib pattern at a greater angle is not limited to the aforesaid method, but a lens for refracting parts of the exposure light to be projected onto the longitudinally opposite end formation regions may be employed to locally change the light projection angle.

While the barrier rib master pattern preparation method has thus been described, a barrier rib pattern can be formed directly on a PDP glass substrate in substantially the same manner as the barrier rib master pattern preparation method by employing a PDP glass substrate formed with electrodes and a dielectric layer instead of the substrate 31 and by forming a photosensitive barrier rib material layer instead of the photosensitive material layer 32 by applying a photosensitive barrier rib material such as a glass paste composed of a low melting point glass frit, a binder, a solvent and the like onto the PDP glass substrate and drying the photosensitive barrier rib material. The barrier rib pattern thus formed is dried and baked by a known method for formation of barrier ribs.

The rib pattern, particularly of a cross grid configuration, having tapered side walls cannot be formed by the conventional metal pattern cutting method, but can easily be formed by the photolithography technique employing the oblique exposure in accordance with the present invention. Particularly, where a photosensitive material sheet having a uniform thickness is employed, the barrier rib master pattern can easily be formed with a higher level of height accuracy.

Thus, straight or cross grid barrier ribs having a finely controlled taper angle can be formed in accordance with the present invention.

Next, an explanation will be given to how to release the barrier rib pattern formed of the barrier rib material in the intaglio pattern prepared with the use of the barrier rib master pattern according to the aforesaid example when the barrier rib pattern is transferred onto the PDP substrate.

Figure 19:
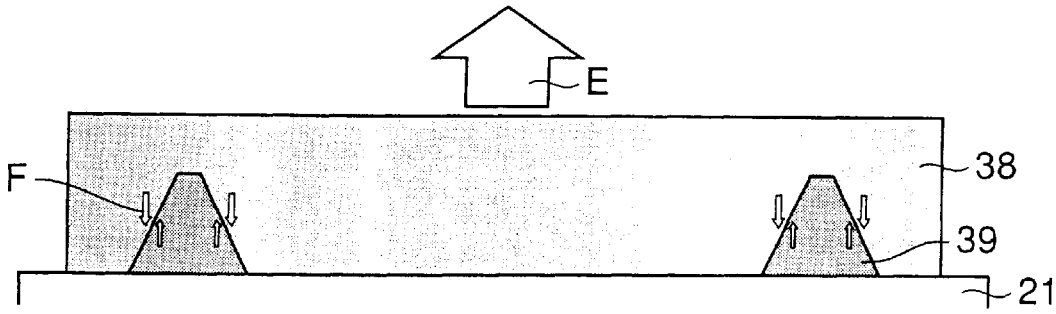
FIGS. 19 and 20 are diagrams for explaining how a barrier rib pattern is released when cross grid barrier ribs having upwardly tapered side walls are formed by the transfer method.
Figure 20:
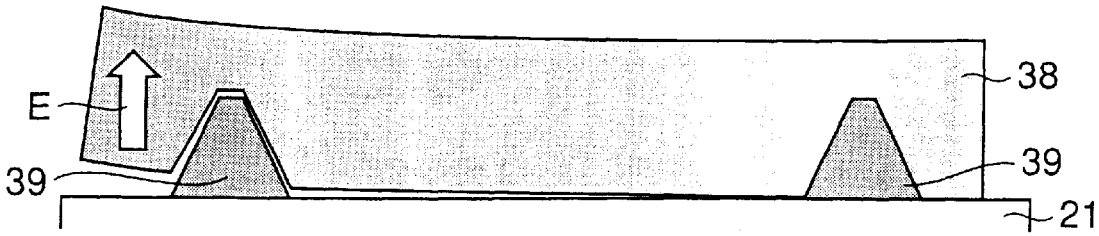

FIGS. 19 and 20 are diagrams for explaining how a barrier rib pattern is released when cross grid barrier ribs having upwardly tapered side walls are formed by the transfer method. Particularly, FIG. 19 is a sectional view of barrier rib portions extending parallel to the intaglio pattern peeling direction, and FIG. 20 is a sectional view of barrier rib portions extending perpendicularly to the peeling direction.

When the barrier rib pattern 39 formed of the barrier rib material in the intaglio pattern 38 is transferred onto the PDP rear glass substrate 21 and released from the intaglio pattern 38 by peeling off the intaglio pattern 38 in a direction parallel to the barrier rib portions as indicated by an arrow E in FIG. 19, a smaller frictional force F occurs between the intaglio pattern 38 and the barrier rib pattern 39 because the barrier rib pattern has the upwardly tapered side walls. Therefore, the geometry of the barrier rib pattern is advantageous for peeling off the intaglio pattern, as compared with a barrier rib pattern having non-tapered side walls. Accordingly, a force required for peeling off the intaglio pattern is reduced to suppress a peeling failure.

When the barrier rib pattern 39 formed of the barrier rib material in the intaglio pattern 38 is transferred onto the PDP rear glass substrate 21 and released from the intaglio pattern 38 by peeling off the intaglio pattern in a direction perpendicular to the barrier rib portions as indicated by an arrow E in FIG. 20, interference between the intaglio pattern 38 and the barrier rib pattern 39, which would cause deformation of the barrier rib pattern if the barrier rib pattern had non-tapered side walls, can be prevented because the barrier rib pattern has the tapered side walls. Thus, the deformation of the barrier rib pattern can be suppressed.

Figure 21:
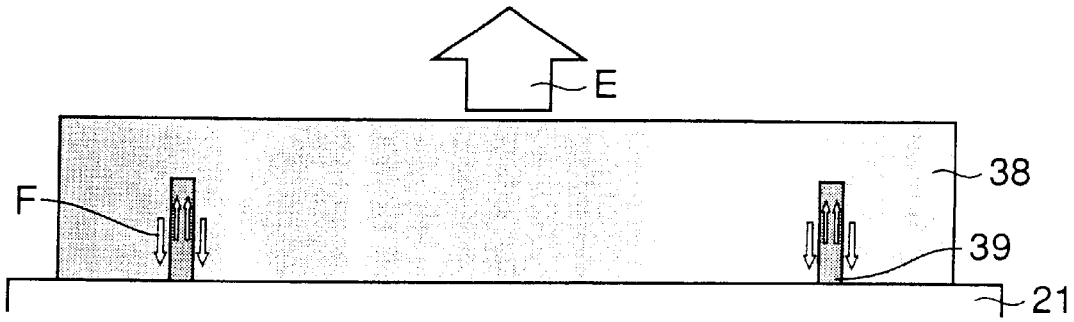
FIGS. 21 and 22 are diagrams for explaining, in comparison to FIGS. 19 and 20, respectively, how a barrier rib pattern is released when cross grid barrier ribs having non-tapered side walls are formed by the transfer method.
Figure 22:
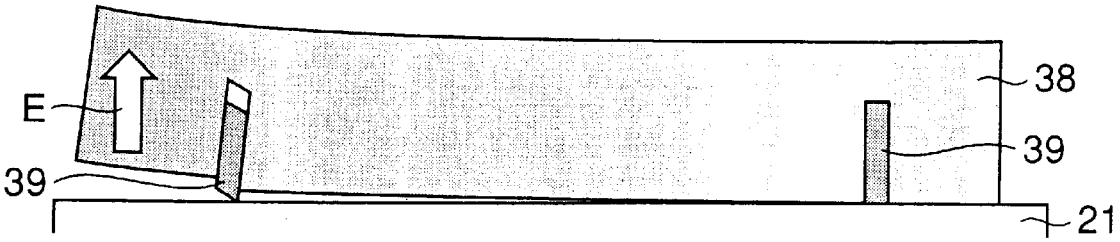

FIGS. 21 and 22 are diagrams for explaining how a barrier rib pattern is released when cross grid barrier ribs having non-tapered side walls are formed by the transfer method. Particularly, FIG. 21 is a sectional view of barrier rib portions extending parallel to the intaglio pattern peeling direction, and FIG. 22 is a sectional view of barrier rib portions extending perpendicularly to the peeling direction.

When the barrier rib pattern 39 formed of the barrier rib material in the intaglio pattern 38 is transferred onto the PDP rear glass substrate 21 and released from the intaglio pattern 38 by peeling off the intaglio pattern 38 in a direction parallel to the barrier rib portions as indicated by an arrow E in FIG. 21, a greater frictional force F occurs between the intaglio pattern 38 and the barrier rib pattern 39 because the barrier rib pattern has the non-tapered side walls. Accordingly, a force required for peeling off the intaglio pattern is increased, as compared with the barrier rib pattern having the upwardly tapered side walls. Therefore, a peeling failure is more liable to occur.

When the barrier rib pattern 39 formed of the barrier rib material in the intaglio pattern 38 is transferred onto the PDP rear glass substrate 21 and released from the intaglio pattern 38 in a direction perpendicular to the barrier rib portions as indicated by an arrow E in FIG. 22, the intaglio pattern 38 interferes with the barrier rib pattern 39 because the barrier rib pattern has the non-tapered side walls. Therefore, the barrier rib pattern is more liable to be deformed.

Figure 23:
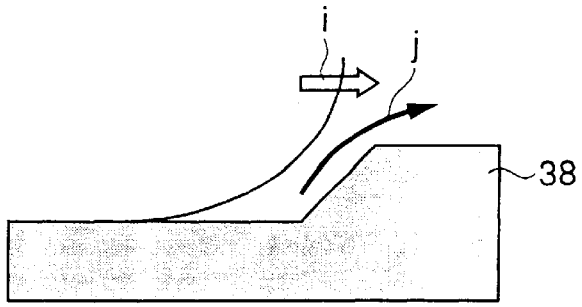
FIG. 23 is a diagram for explaining how tapered longitudinal end portions of a barrier rib pattern are formed by filling an intaglio pattern with a barrier rib material.
Figure 24:
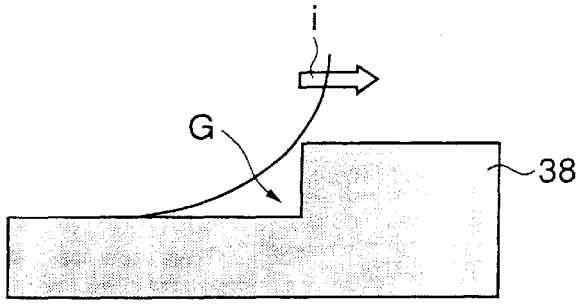
FIG. 24 is a diagram for explaining, in comparison to FIG. 23, how non-tapered longitudinal end portions of a barrier rib pattern are formed.

FIG. 23 is a diagram for explaining how longitudinal end portions of a barrier rib pattern are formed by filling the intaglio pattern with the barrier rib material. FIG. 24 is a diagram for explaining, in comparison to FIG. 23, how non-tapered longitudinal end portions of a barrier rib pattern are formed.

As shown in these figures, the barrier rib material paste is filled in the intaglio pattern 38 in a direction indicated by arrows i. Where the barrier rib pattern to be formed has the non-tapered longitudinal end portions, it is difficult to expel air from longitudinal end portions G of the intaglio pattern as shown in FIG. 24, so that air bubbles are liable to be trapped in the longitudinal end portions G. Where the barrier rib pattern to be formed has the tapered longitudinal end portions, on the other hand, air is easily expelled from the intaglio pattern in a direction indicated by an arrow j in FIG. 23, so that air bubbles are prevented from being trapped in the intaglio pattern.

Figure 25:
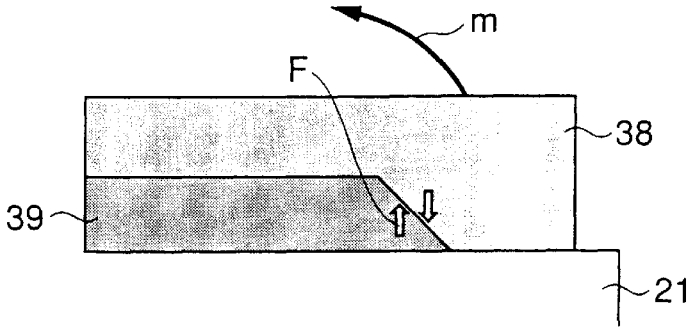
FIG. 25 is a diagram for explaining how the tapered longitudinal end portions of the barrier rib pattern are released at the transfer of the barrier rib pattern.
Figure 26:
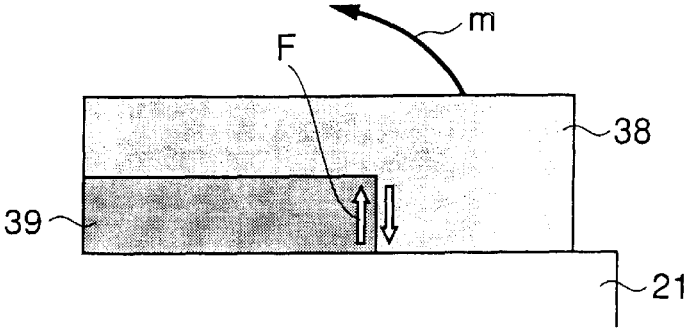
FIG. 26 is a diagram for explaining, in comparison to FIG. 25, how the non-tapered longitudinal end portions of the barrier rib pattern are released.

FIG. 25 is a diagram for explaining how the longitudinal end portions of the barrier rib pattern are released when the barrier rib pattern is transferred. FIG. 26 is a diagram for explaining, in comparison to FIG. 25, how the non-tapered longitudinal end portions of the barrier rib pattern are released.

As shown in these figures, the barrier rib pattern 39 formed of the barrier rib material in the intaglio pattern 38 is transferred onto the PDP substrate and then the intaglio pattern 38 is peeled off in a direction indicated by an arrow m. Where the barrier rib pattern has the non-tapered longitudinal ends, a peeling failure is liable to occur. This is because a frictional force F occurring between the intaglio pattern and the barrier rib pattern is different depending on whether or not the barrier rib pattern has the tapered longitudinal ends.

That is, where the barrier rib pattern has the non-tapered longitudinal ends, a greater frictional force F occurs between the intaglio pattern 38 and the barrier rib pattern 39, so that the peeling failure is liable to occur. Where the barrier rib pattern has the tapered longitudinal ends, on the other hand, the geometry of the barrier rib pattern is more advantageous for peeling off the intaglio pattern, so that the possibility of the peeling failure can be reduced.

Figure 27:
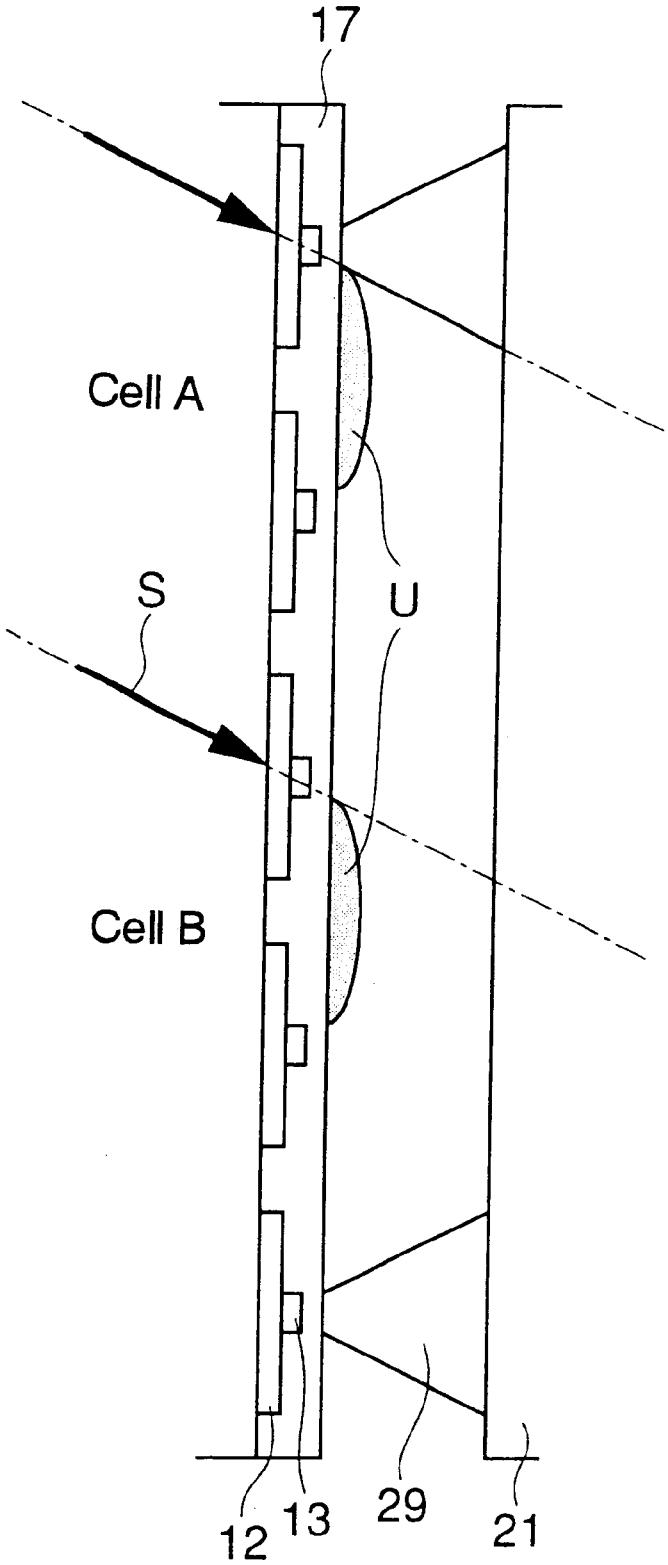
FIG. 27 is a vertical sectional view illustrating a part of an AC-driven tri-electrode surface discharge PDP of the ALiS structure with lateral barrier ribs having tapered side walls.
Figure 28:
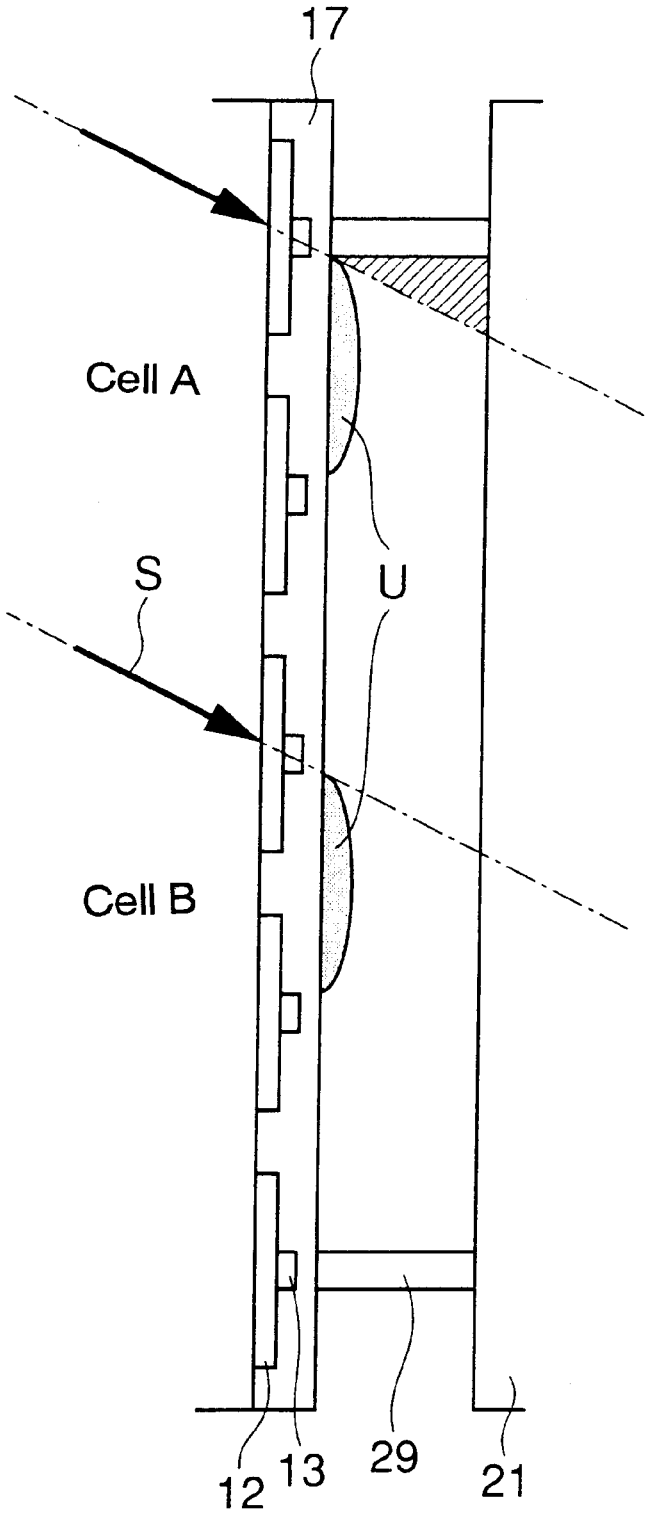
FIG. 28 is a diagram illustrating a PDP with lateral barrier ribs having non-tapered side walls in comparison to FIG. 27.

FIGS. 27 and 28 are vertical sectional views illustrating parts of AC-driven tri-electrode surface discharge PDPs of the ALiS structure. Particularly, FIG. 27 is a PDP with lateral barrier ribs having tapered side walls. FIG. 28 is a PDP with lateral barrier ribs having non-tapered side walls in comparison to FIG. 27.

As shown in these figures, the PDP with the lateral barrier ribs having the tapered side walls has a reduced luminous variation between cells, so that flickering dependent on a vertical view angle can be prevented.

When discharge U occurs in cells A and B of the PDP with the lateral barrier ribs having the non-tapered side walls, the cell A apparently has a lower luminance than the cell B as viewed in a direction indicated by an arrow S in FIG. 28 due to shadowing by the barrier rib 29.

When discharge U occurs in cells A and B of the PDP with the lateral barrier ribs having the tapered side walls, a reduction in the luminance of the cell A as compared with the cell B is apparently suppressed as viewed in a direction indicated by an arrow S in FIG. 27, because the shadowing by the barrier rib 29 does not occur. Thus, the flickering dependent on the vertical view angle is suppressed.

Figure 29:
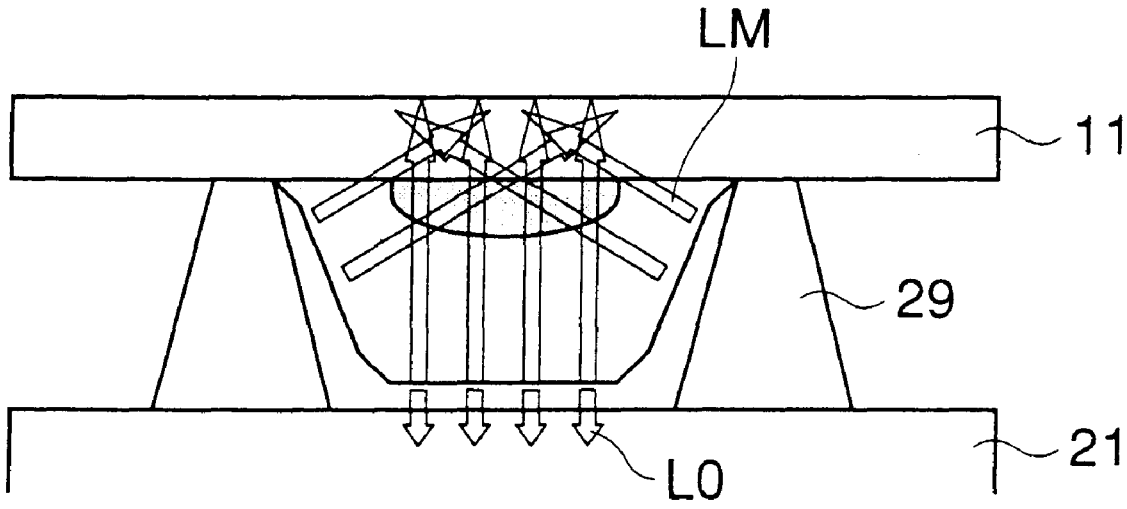
FIG. 29 is a diagram illustrating the cell structure of an AC-driven tri-electrode surface discharge PDP of the ALiS structure with lateral barrier ribs having tapered side walls.
Figure 30:
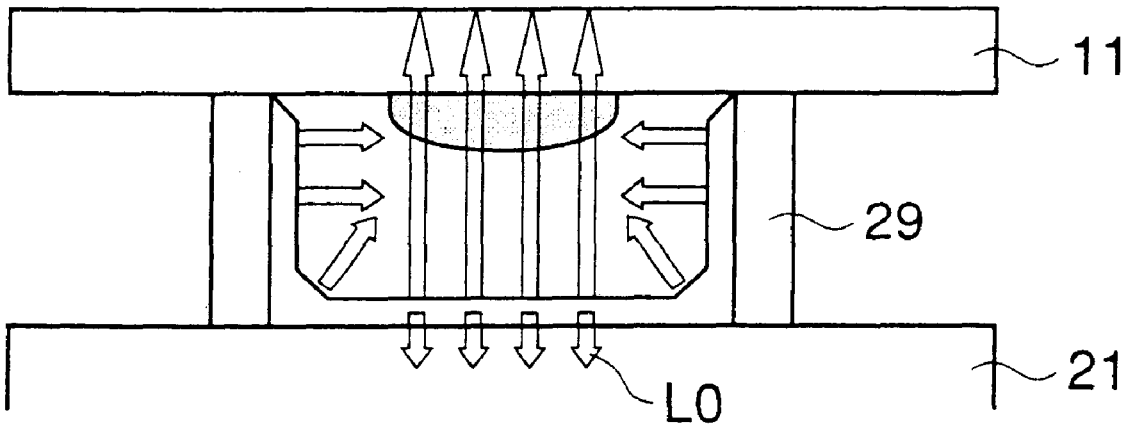
FIG. 30 is a diagram illustrating a PDP with lateral barrier ribs having non-tapered side walls in comparison to FIG. 29.

FIGS. 29 and 30 are diagrams illustrating the cell structures of the AC-driven tri-electrode surface discharge PDPs of the ALiS structure. Particularly, FIG. 29 illustrates the PDP with the lateral barrier ribs having the tapered side walls, and FIG. 30 illustrates the PDP with the lateral barrier ribs having the non-tapered side walls in comparison to FIG. 29.

As shown in these figures, the lateral barrier ribs having the tapered side walls can efficiently direct the light emitted in the cell toward the display surface. A certain amount LO of the light emitted in the cell is leaked to the rear side whether or not the barrier ribs have the tapered side walls. Where the barrier ribs have the tapered side walls, however, a certain amount LM of the light emitted in the cell is reflected obliquely on the tapered side walls toward the display surface, so that the light emitted in the cell can efficiently be directed toward the display surface.

As described above, the barrier rib master pattern with the upwardly tapered side walls is formed by employing the photosensitive master pattern material and carrying out the oblique exposure at least twice. Further, the PDP rear substrate with the barrier ribs having the upwardly tapered side walls is produced by employing the photosensitive barrier rib material and carrying out the oblique exposure at least twice.

The use of the photosensitive material allows for the formation of the cross grid barrier rib master pattern which is difficult with the conventional metal pattern cutting method.

The oblique exposure makes it possible to taper the side walls of the rib pattern of the barrier rib master pattern at a variably controlled taper angle and to taper the longitudinal ends of the rib pattern of the barrier rib master pattern. Thus, the barrier rib pattern releasing operation can be facilitated for improvement of the yield for the formation of the barrier ribs by the transfer method.

Since the barrier ribs have the upwardly tapered side walls, the light emitted in the cells of the PDP can efficiently be directed toward the display surface. Where the lateral barrier ribs have the upwardly tapered side walls, the luminous variation between the cells is reduced, so that the flickering dependent on the vertical view angle can be suppressed.

In accordance with the present invention, the barrier rib master pattern, which has the side walls tapered at a desired taper angle and allows for easy release of the barrier rib pattern when the barrier ribs are formed by the transfer method, can easily be prepared by forming the photosensitive material layer on the substrate and projecting the exposure light obliquely onto the photosensitive material layer with the intervention of the photomask.

What is claimed is:

1. A method of preparing a barrier rib master pattern for barrier rib transfer, comprising the steps of:

forming a photosensitive material layer on a substrate;

performing oblique exposure by projecting exposure light onto the photosensitive material layer with the intervention of a photomask obliquely with respect to the substrate; and developing the photosensitive material layer;

whereby a rib pattern having tapered side walls is formed on the substrate.

2. A method as set forth in claim 1, wherein, in order that the rib pattern includes rib portions each having a trapezoidal cross section with opposite side walls upwardly tapered, the oblique exposure is performed by projecting the exposure light in each of directions corresponding to inclinations of the opposite side walls of the rib portions.

3. A method as set forth in claim 2, wherein the rib pattern to be formed on the substrate includes rib portions each having a gently tapered longitudinal end, the method further comprising the step of:

projecting exposure light onto a longitudinal end formation region of the photosensitive material layer obliquely with respect to the substrate after the oblique exposure.

4. A method as set forth in claim 1, wherein the rib pattern to be formed on the substrate has a cross grid configuration as viewed in plan, and includes vertical rib portions and lateral rib portions each having opposite side walls upwardly tapered, and the oblique exposure is performed four times by projecting the exposure light in directions corresponding to inclinations of the opposite side walls of the vertical rib portions and in directions corresponding to inclinations of the opposite side walls of the lateral rib portions.

5. A method as set forth in claim 4, wherein the rib pattern to be formed on the substrate has a cross grid configuration as viewed in plan, and includes first rib portions each extending in a first direction and having opposite side walls upwardly tapered and second rib portions each extending in a second direction perpendicular to the first direction and having opposite side walls upwardly tapered less steeply than the side walls of the first rib portions, and the oblique exposure is performed four times by projecting the exposure light at different angles with respect to the substrate in directions corresponding to inclinations of the opposite side walls of the first rib portions and in directions corresponding to inclinations of the opposite side walls of the second rib portions, whereby a barrier rib pattern formed of a barrier rib material in an intaglio pattern prepared with the use of the barrier rib master pattern is transferred onto a PDP substrate and released from the intaglio pattern by peeling off the intaglio pattern in the first direction.

6. A method as set forth in claim 4, wherein the rib pattern to be formed on the substrate includes rib portions each having a gently tapered longitudinal end, the method further comprising the step of:

projecting exposure light onto a longitudinal end formation region of the photosensitive material layer obliquely with respect to the substrate after the oblique exposure.

7. A method as set forth in claim 1, wherein the rib pattern to be formed on the substrate includes rib portions each having a gently tapered longitudinal end, the method further comprising the step of:

projecting exposure light onto a longitudinal end formation region of the photosensitive material layer obliquely with respect to the substrate after the oblique exposure.

8. A plasma display panel comprising barrier ribs formed by a method comprising the steps of:

forming an intaglio pattern with the use of a barrier rib master pattern prepared by a method as recited in claim 1;

filling a barrier rib material in the intaglio pattern for formation of a barrier rib pattern; and transferring the barrier rib pattern onto a substrate.

9. A method of forming barrier ribs, comprising the steps of:

forming a photosensitive barrier rib material layer on a substrate;

projecting exposure light onto the barrier rib material layer with the intervention of a photomask obliquely with respect to the substrate; and developing the barrier rib material layer, whereby barrier ribs each having tapered side walls are formed on the substrate.

* * * * *